US008608018B2

(12) United States Patent
Babinsky et al.

(10) Patent No.: US 8,608,018 B2
(45) Date of Patent: Dec. 17, 2013

(54) INSULATED CONTAINER WITH COMFORT ZONE

(75) Inventors: Vladislav Babinsky, Midlothian, VA (US); Sven Samuel Arenander, Richmond, VA (US); Melvin Joshua Leedle, St. Louis, MO (US); Jonathan P. Sundy, Columbia, MO (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 13/476,123

(22) Filed: May 21, 2012

(65) Prior Publication Data

US 2013/0306630 A1 Nov. 21, 2013

(51) Int. Cl.
*B65D 25/00* (2006.01)

(52) U.S. Cl.
USPC ..... 220/739; 220/592.2; 220/660; 220/703; 220/738; 220/813; 220/903; 229/122.32; 229/403; 493/115; 206/669; 206/674; 206/676; 206/737; 206/738; 206/739

(58) Field of Classification Search
USPC ..... 220/592.2, 660, 703, 738, 739, 903; 229/122.32, 403; 493/115; 206/669, 206/674, 676, 737, 738, 739, 903
See application file for complete search history.

(56) References Cited

U.S. PATENT DOCUMENTS

| | | | | |
|---|---|---|---|---|
| 2,622,051 A | | 12/1952 | Hermanson et al. | |
| D202,507 S | | 10/1965 | Shelby | |
| 3,908,523 A | | 9/1975 | Shikaya | |
| 4,549,672 A | | 10/1985 | Rinkewich | |
| 4,964,933 A | | 10/1990 | Hata et al. | |
| 5,145,107 A | | 9/1992 | Silver et al. | |
| 5,226,585 A | | 7/1993 | Varano | |
| 5,296,307 A | | 3/1994 | Bernstein | |
| 5,363,982 A | | 11/1994 | Sadlier | |
| 5,385,260 A | | 1/1995 | Gatcomb | |
| 5,425,497 A | * | 6/1995 | Sorensen | 220/738 |
| 5,508,072 A | | 4/1996 | Andersen et al. | |
| 5,609,711 A | | 3/1997 | Miller | |
| 5,651,851 A | | 7/1997 | Gatcomb | |
| 5,660,900 A | | 8/1997 | Andersen et al. | |
| 5,709,913 A | | 1/1998 | Andersen et al. | |
| 5,736,209 A | | 4/1998 | Andersen et al. | |

(Continued)

FOREIGN PATENT DOCUMENTS

| | | | | |
|---|---|---|---|---|
| EP | 0695692 | * | 5/1995 | B65D 3/22 |
| EP | 0695692 | | 2/1996 | |
| WO | 2010/151456 | | 12/2010 | |
| WO | 2012/057933 | | 5/2012 | |

OTHER PUBLICATIONS

International Search Report and Written Opinion, PCT/US2013/037531 (2013).

*Primary Examiner* — Anthony Stashick
*Assistant Examiner* — Elizabeth Volz
(74) *Attorney, Agent, or Firm* — MeadWestvaco Intellectual Property Group

(57) ABSTRACT

A container including a base container having a side wall that extends about a longitudinal axis to define an internal volume and an overwrap positioned over the side wall, the overwrap including a first zone circumferentially extending about the base container, the first zone including a first pattern of bosses, and a second zone circumferentially extending about the base container, the second zone including a second pattern of bosses, the second pattern of bosses being different than the first pattern of bosses.

18 Claims, 6 Drawing Sheets

(56) References Cited

U.S. PATENT DOCUMENTS

| | | | |
|---|---|---|---|
| 5,820,016 | A | 10/1998 | Stropkay |
| 5,826,786 | A | 10/1998 | Dickert |
| 5,868,824 | A | 2/1999 | Andersen et al. |
| 5,910,350 | A | 6/1999 | Loracks et al. |
| 5,928,741 | A | 7/1999 | Andersen et al. |
| 5,964,400 | A | 10/1999 | Varano et al. |
| 5,976,235 | A | 11/1999 | Andersen et al. |
| 6,053,352 | A | 4/2000 | Cai |
| 6,083,586 | A | 7/2000 | Andersen et al. |
| 6,126,584 | A | 10/2000 | Zadravetz |
| 6,152,363 | A | 11/2000 | Rule, Jr. |
| 6,168,857 | B1 | 1/2001 | Andersen et al. |
| 6,231,970 | B1 | 5/2001 | Andersen et al. |
| 6,250,545 | B1 | 6/2001 | Mazzarolo et al. |
| 6,277,454 | B1 | 8/2001 | Neale et al. |
| 6,537,680 | B1 | 3/2003 | Norlander et al. |
| D475,578 | S | 6/2003 | Hurlbut et al. |
| 6,589,327 | B1 | 7/2003 | Snidow |
| 6,598,786 | B1 | 7/2003 | Guo |
| 6,811,843 | B2 | 11/2004 | DeBraal et al. |
| 6,852,381 | B2 | 2/2005 | DeBraal et al. |
| 6,878,199 | B2 | 4/2005 | Bowden et al. |
| 6,878,390 | B2 | 4/2005 | Murray et al. |
| 6,926,197 | B2 | 8/2005 | Hed et al. |
| 7,056,563 | B2 | 6/2006 | Halabisky |
| 7,060,159 | B2 | 6/2006 | Halabisky |
| 7,063,771 | B2 | 6/2006 | Halabisky et al. |
| 7,074,466 | B2 | 7/2006 | DeBraal et al. |
| 7,175,730 | B2 | 2/2007 | Benim et al. |
| 7,306,834 | B2 | 12/2007 | Nonomura et al. |
| 7,387,702 | B2 | 6/2008 | Norlander |
| 7,402,618 | B2 | 7/2008 | Xu |
| 7,556,757 | B2 | 7/2009 | Xu |
| D603,653 | S | 11/2009 | Wang |
| 7,717,325 | B2 | 5/2010 | Puls et al. |
| 7,767,049 | B2 | 8/2010 | Sadlier |
| 7,811,644 | B2 | 10/2010 | DeBraal et al. |
| 8,006,861 | B2 | 8/2011 | Kim |
| D656,365 | S * | 3/2012 | Bickert et al. ..... D7/624.2 |
| 2002/0172784 | A1 | 11/2002 | DeBraal et al. |
| 2002/0172818 | A1 | 11/2002 | DeBraal et al. |
| 2004/0070223 | A1 | 4/2004 | Wong |
| 2004/0082678 | A1 | 4/2004 | Xu |
| 2005/0040218 | A1 * | 2/2005 | Hinchey et al. ..... 229/403 |
| 2005/0146073 | A1 | 7/2005 | Guloy |
| 2005/0236468 | A1 | 10/2005 | Sadlier |
| 2006/0027640 | A1 | 2/2006 | Smith et al. |
| 2007/0215626 | A1 | 9/2007 | Wright et al. |
| 2007/0228134 | A1 | 10/2007 | Cook et al. |
| 2008/0121681 | A1 | 5/2008 | Wiedmeyer |
| 2008/0290103 | A1 * | 11/2008 | Robertson et al. ..... 220/737 |
| 2009/0321460 | A1 * | 12/2009 | Kim ..... 220/738 |
| 2010/0072268 | A1 | 3/2010 | Johnson et al. |
| 2010/0181328 | A1 | 7/2010 | Cook et al. |
| 2010/0187296 | A1 | 7/2010 | Puls et al. |
| 2011/0139660 | A1 | 6/2011 | Cabell et al. |
| 2012/0097685 | A1 * | 4/2012 | Babinsky et al. ..... 220/592.2 |

* cited by examiner

INSULATED CONTAINER WITH COMFORT ZONE

FIELD

This application relates to containers and, more particularly, to insulated containers, such as insulated beverage cups.

BACKGROUND

Beverage containers are used to hold both hot beverages (e.g., coffee) and cold beverages (e.g., soda). Unfortunately, hot beverages rapidly cool once placed in a typical beverage container. The use of a tight-fitting lid may inhibit cooling. However, a significant portion of the cooling is typically effected by heat transfer from the hot beverage, across the walls of the beverage container and, ultimately, to the ambient atmosphere.

Heat transfer across the walls of beverage containers has an opposite effect on cold beverages. Specifically, cold beverages warm over time, which may result in melting of the ice and, thus, unintentional dilution of the beverage. Furthermore, in humid environments, water droplets (i.e., condensation) tend to form on the external surface of poorly insulated beverage containers housing cold beverages. Such condensation may pool over time.

Furthermore, heat transfer across the walls of the beverage containers may significantly increase the surface temperature of the beverage container, which may render the beverage container too hot to comfortably handle, or may significantly decrease the surface temperature of the beverage container, which may render the beverage container too cold to comfortably handle.

Thus, efforts have been made to insulate the walls of beverage containers. Unfortunately, these efforts have encountered various obstacles. For example, polystyrene foam beverage containers provide improved insulation, but tend to be fragile and are not biodegradable. Environmentally friendly beverage containers, while more structurally robust than polystyrene foam containers, tend to provide only limited insulation.

Accordingly, those skilled in the art continue with research and development efforts in the field of insulated containers.

SUMMARY

Disclosed is an insulated container having a base container and an overwrap received over the base container. The overwrap may include a comfort zone where users may comfortably grasp the container. The comfort zone may have a relatively lower surface temperature (vis-à-vis the rest of the overwrap) due to selective placement of embossings, debossings and/or adhesive.

In one embodiment, the disclosed insulated container may include a base container having a side wall that extends about a longitudinal axis to define an internal volume and an overwrap positioned over the side wall, the overwrap including a first zone and a second zone, the first and second zones circumferentially extending about the base container, wherein the first zone comprises a first pattern of bosses and the second zone comprises a second pattern of bosses, the second pattern of bosses being different than the first pattern of bosses.

In another embodiment, the disclosed insulated container may include a base container having a side wall that extends about a longitudinal axis to define an internal volume and an overwrap positioned over the side wall, the overwrap including a first zone circumferentially extending about the base container, the first zone being defined by a first pattern of bosses, a second zone circumferentially extending about the base container, the second zone being defined by a second pattern of bosses, and a third zone circumferentially extending about the base container, the third zone being defined by a third pattern of bosses, wherein the first zone is positioned between the second zone and the third zone, and wherein the first pattern of bosses is different than the second and third patterns of bosses, and an adhesive positioned between the base container and the overwrap.

In another embodiment, the disclosed insulated container may include a base container having a side wall that extends about a longitudinal axis to define an internal volume and an overwrap positioned over the side wall, the overwrap including a first zone circumferentially extending about the base container, the first zone including a first outer surface having a first average surface temperature, and a second zone circumferentially extending about the base container, the second zone including a second outer surface having a second average surface temperature, wherein the first average surface temperature is at least 2° C. less than the second average surface temperature when the internal volume is filled with water at a temperature of 90° C. under TAPPI standard conditions.

In another embodiment, the disclosed insulated container may include a base container having a side wall that extends about a longitudinal axis to define an internal volume and an overwrap positioned over the side wall, the overwrap including a first zone circumferentially extending about the base container, the first zone having an inner surface and an outer surface, and a second zone circumferentially extending about the base container, the second zone having an inner surface and an outer surface, and an adhesive positioned between the side wall and the overwrap such that the adhesive covers at most 5 percent of the inner surface of the first zone and more than 5 percent of the inner surface of the second zone.

In yet another embodiment, the disclosed insulated container may include a base container having a side wall that extends about a longitudinal axis to define an internal volume and an overwrap positioned over the side wall, the overwrap including a first zone circumferentially extending about the base container, the first zone having an inner surface and an outer surface, the outer surface of the first zone having a first average surface temperature, and a second zone circumferentially extending about the base container, the second zone having an inner surface and an outer surface, the outer surface of the second zone having a second average surface temperature, and an adhesive positioned between the side wall and the overwrap such that the first average surface temperature is at least 2° C. less than the second average surface temperature when the internal volume is filled with water at a temperature of 90° C. under TAPPI standard conditions.

Other embodiments of the disclosed insulated container with comfort zone will become apparent from the following description, the accompanying drawings and the appended claims.

DETAILED DESCRIPTION

Figure 1:
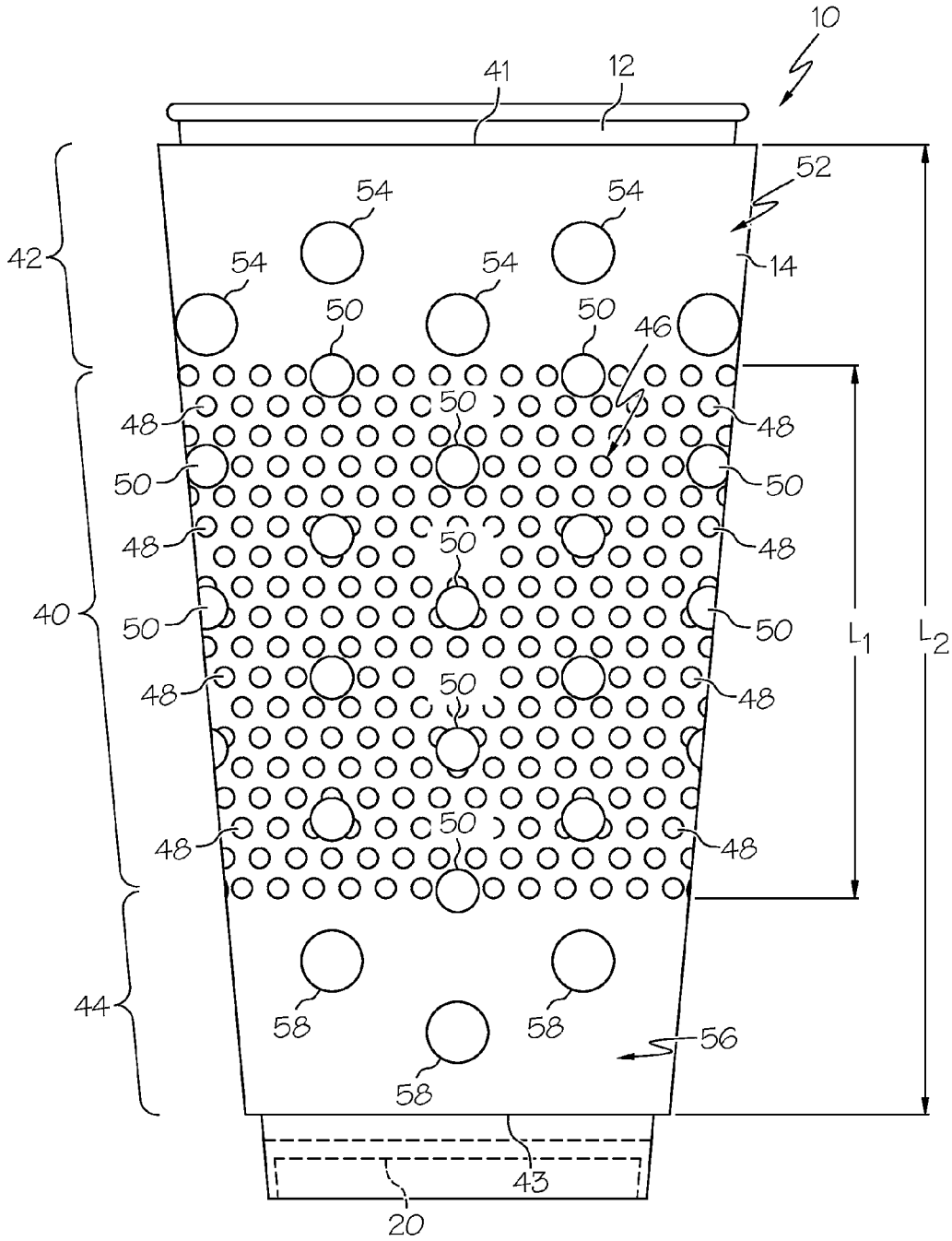
FIG. 1 is a front elevational view of one embodiment of the disclosed insulated container with comfort zone.

The disclosed insulated container with comfort zone may be formed as a multi-wall (e.g., double-wall) beverage cup, such as a 12-ounce, 16-ounce or 24-ounce disposable beverage cup. The insulated container may have a generally frustoconical shape, as shown in the drawings, though insulated containers having various shapes and configurations may be constructed without departing from the scope of the present disclosure.

Figure 2:
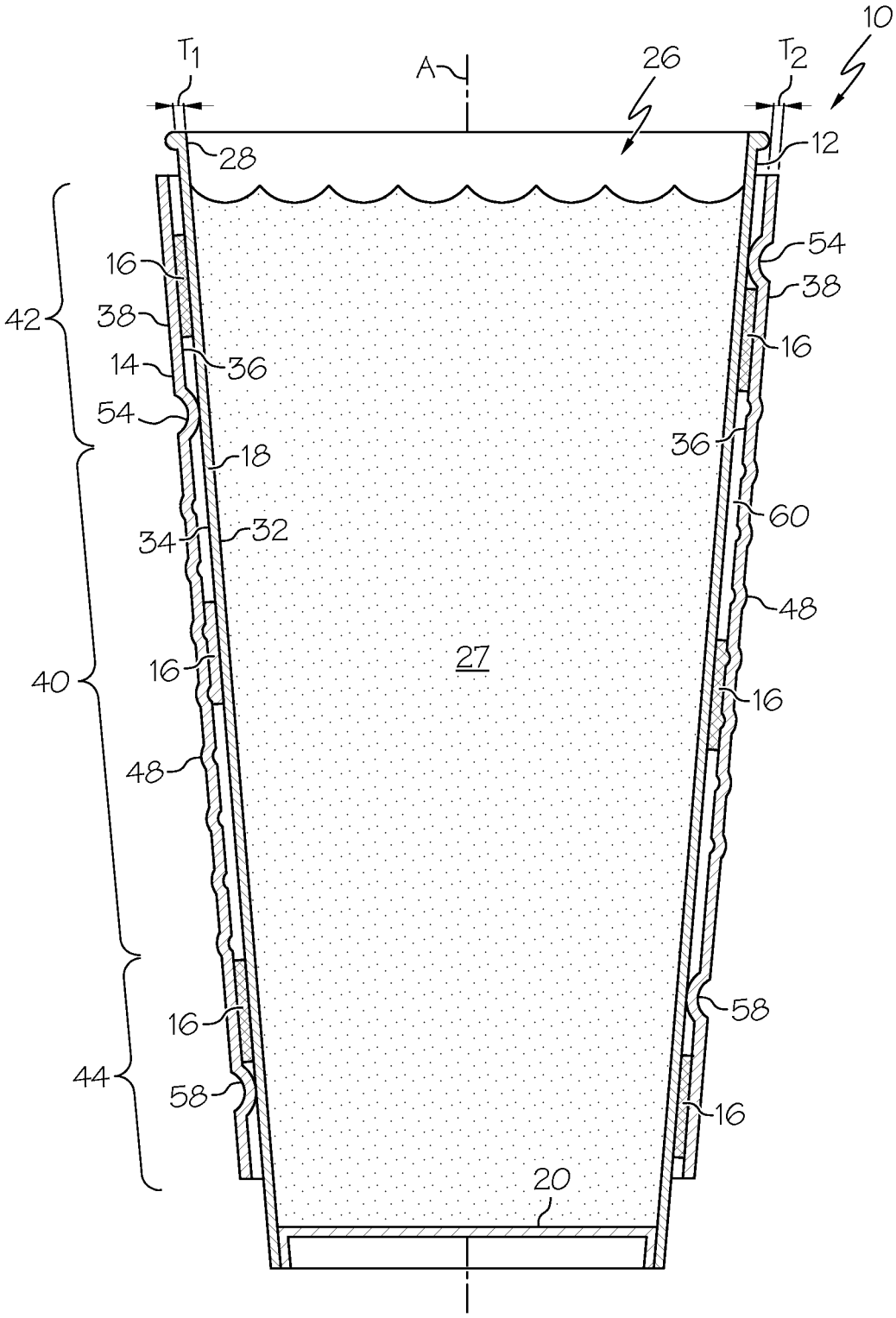
FIG. 2 is a front elevational view, in section, of the insulated container of FIG. 1.

Referring to FIGS. 1 and 2, one embodiment of the disclosed insulated container with comfort zone, generally designated 10, may include a base container 12 and an overwrap 14. An adhesive 16 (FIGS. 2 and 6) may be positioned between the base container 12 and the overwrap 14 to connect the overwrap 14 to the base container 12. Other techniques for securing the overwrap 14 to the base container 12, such as use of mechanical fasteners, heat sealing or an interference fit, are also contemplated.

Thus, the insulated container 10 may be formed as a layered structure that includes a base container 12, an overwrap 14 and an adhesive 16. Additional layers, such as additional adhesive layers and additional overwrap layers, may be included without departing from the scope of the present disclosure.

Figure 3:
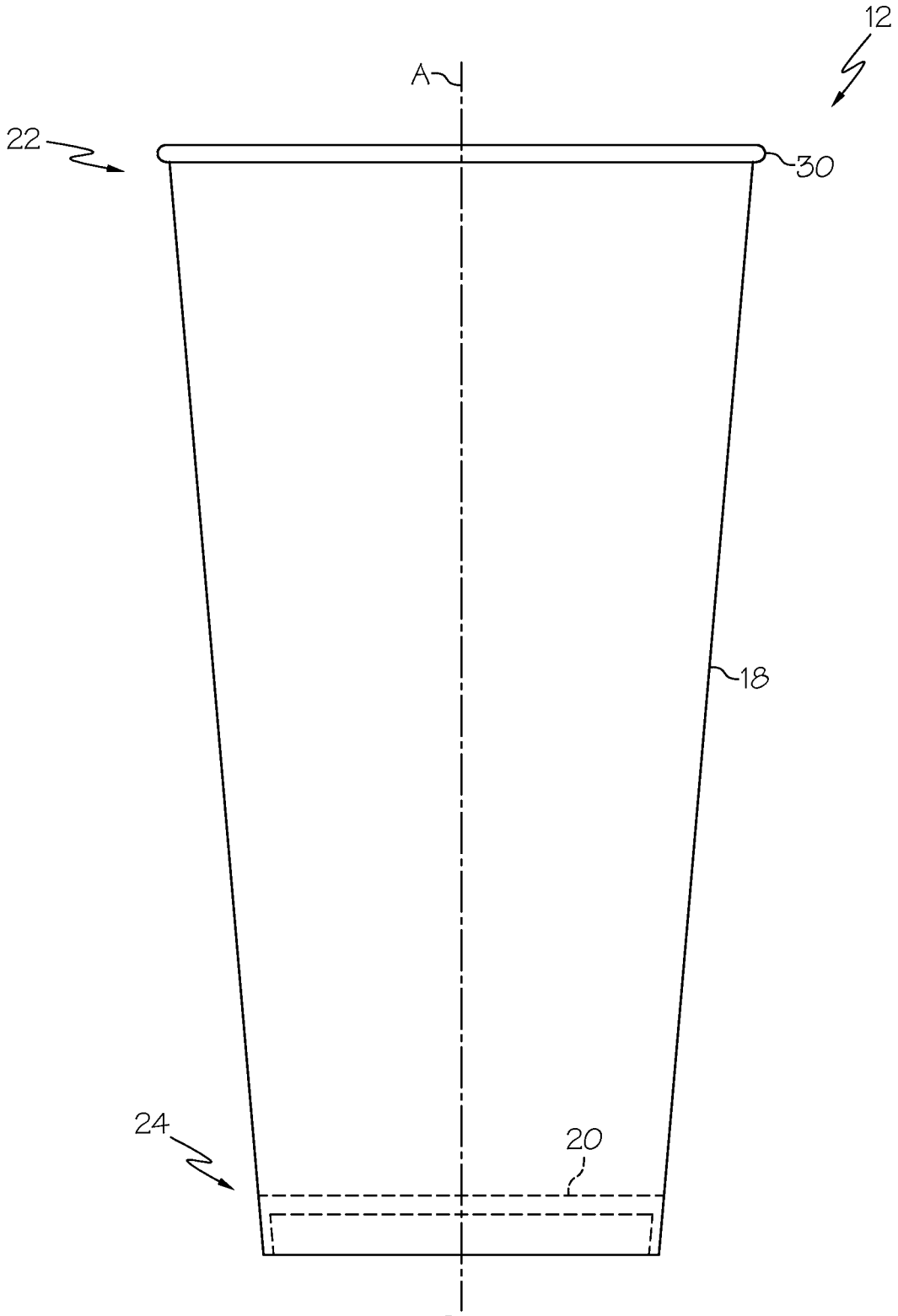
FIG. 3 is a front elevational view of the base container of the insulated container of FIG. 1.

Referring to FIG. 3, the base container 12 may include a side wall 18 and a base wall 20. The side wall 18 of the base container 12 may include an upper end portion 22 and a lower end portion 24, and may extend circumferentially about a longitudinal axis A to define an internal volume 26 (FIG. 2). The base wall 20 may be connected to the lower end portion 24 of the side wall 18 to partially enclose the internal volume 26. The upper end portion 22 of the side wall 18 may define an opening 28 (FIG. 2) into the internal volume 26 (FIG. 2).

Still referring to FIG. 3, the upper end portion 22 of the side wall 18 of the base container 12 may optionally include a circumferential rim 30. The rim 30 may be formed by outwardly rolling the upper end portion 22 of the side wall 18. Those skilled in the art will appreciate that the rim 30 may provide structure to which a lid (not shown) may be releasably connected to seal the opening 28 (FIG. 2) into the internal volume 26.

As shown in FIG. 2, the side wall 18 of the base container 12 may include an inner surface 32 and an outer surface 34, and may have a cross-sectional thickness $T_1$. Optionally, the inner surface 32 of the side wall 18 may be coated with a moisture barrier material, thereby rendering the side wall 18 resistant to moisture penetration when the internal volume 26 is filled with a liquid 27, such as coffee or soda. For example, the moisture barrier material may be (or may include) a layer of polyethylene that has been laminated, extrusion coated, blow-molded or otherwise connected (e.g., with adhesives) to the inner surface 32 of the side wall 18.

In a first expression, the base container 12 may be a paperboard container. For example, the base container 12 may be formed by shaping a paperboard blank on a cup forming machine, such as the PMC 1002 cup/container machine available from Paper Machinery Corporation of Milwaukee, Wis. The paperboard blank may have a cross-sectional thickness $T_1$ of at least about 6 points, such as about 8 to about 24 points, wherein 1 point equals 0.001 inch.

In a second expression, the base container 12 may be a polymeric container. As one example of the second expression, the base container 12 may be formed by shaping a polymeric blank, such as polycarbonate or polyethylene terephthalate blank, on a cup forming machine, such as the PMC 1002P container machine available from Paper Machinery Corporation. As another example of the second expression, the base container 12 may be formed by vacuum molding, extrusion molding, injection molding or thermoforming a polymeric material, such as polycarbonate, polyethylene terephthalate or polystyrene.

At this point, those skilled in the art will appreciate that the base container 12 may be formed from various materials using various techniques, and may be configured in various shapes and sizes, without departing from the scope of the present disclosure.

The overwrap 14 may circumferentially extend about the side wall 18 of the base container 12. The overwrap 14 may have an overall surface area that is less than the overall surface area of the side wall 18 of the base container 12. Therefore, the overwrap 14 may cover only a portion of the side wall 18 of the base container 12. As one example, the overwrap 14 may cover at least 60 percent of the side wall of the base container 12. As another example, the overwrap 41 may cover at least 70 percent of the side wall of the base container 12. As another example, the overwrap 14 may cover at least 80 percent of the side wall of the base container 12. As another example, the overwrap 14 may cover at least 90 percent of the side wall of the base container 12. As yet another example, the overwrap 14 may cover at most 95 percent of the side wall of the base container 12.

As shown in FIG. 2, the overwrap 14 may include an inner surface 36 and an outer surface 38, and may have a cross-sectional thickness $T_2$. The adhesive 16 may connect the inner surface 36 of the overwrap 14 to the outer surface 34 of the base container 12.

The overwrap 14 may be formed from paperboard. The paperboard may be bleached or unbleached, and may have a basis weight of at least about 85 pounds per 3000 square feet and a cross-sectional thickness $T_2$ of at least about 6 points. For example, the overwrap 14 may be formed from paperboard, such as linerboard or solid bleached sulfate (SBS), having a basis weight ranging from about 180 to about 270 pounds per 3000 square feet and a thickness $T_2$ ranging from about 12 to 36 points.

Optionally, the paperboard used to form the overwrap 14 may include various components and optional additives in addition to cellulosic fibers. For example, the paperboard used to form the overwrap 14 may optionally include one or more of the following: binders, fillers (e.g., ground wood particles), organic pigments, inorganic pigments, hollow plastic pigments, expandable microspheres and bulking agents, such as chemical bulking agents.

Overwraps 14 formed from materials other than paperboard, such as polymeric materials, are also contemplated.

Figure 4:
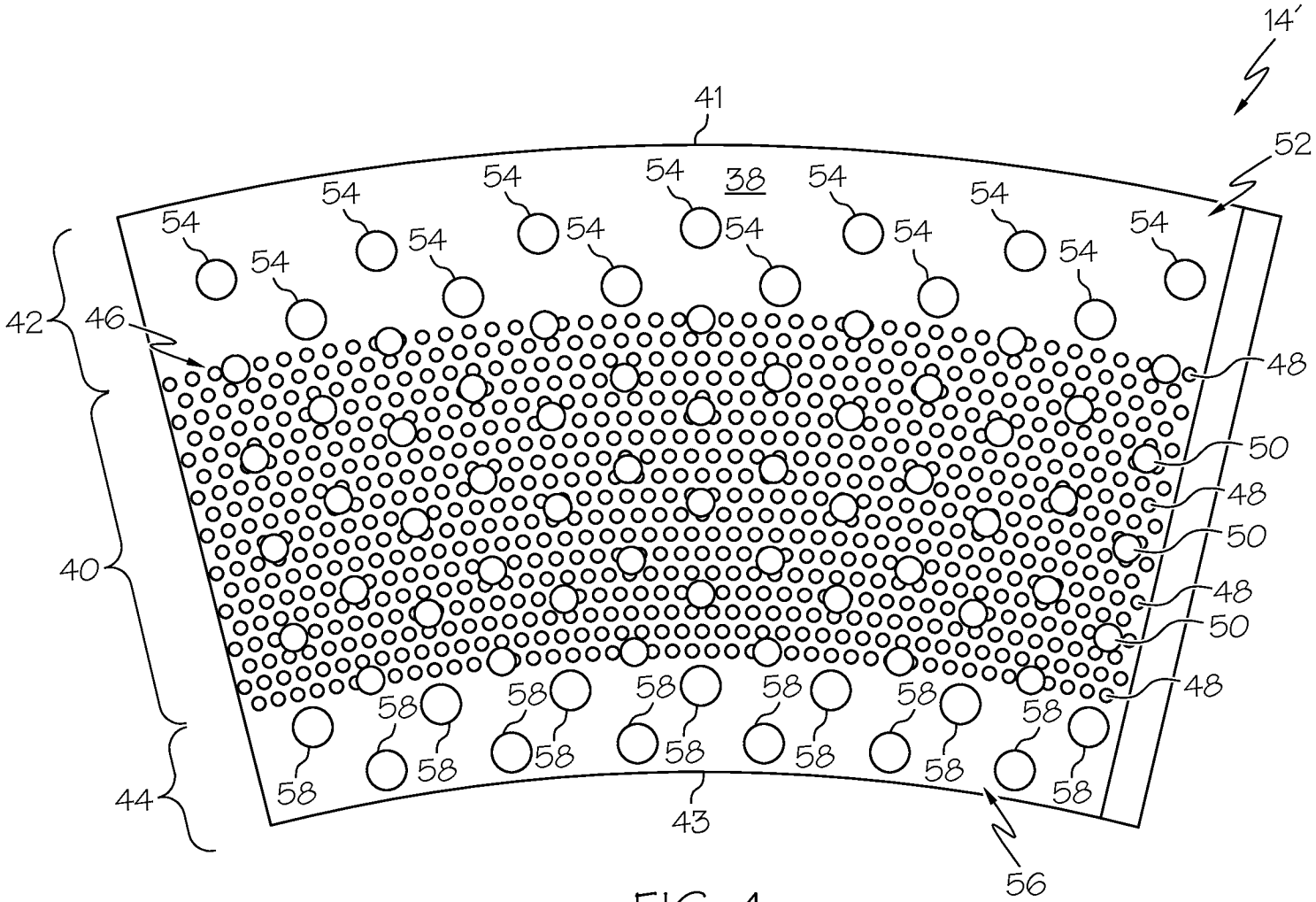
FIG. 4 is a top plan view of the overwrap of the insulated container of FIG. 1, shown prior to being applied to the base container of FIG. 3.

Referring to FIG. 4, the overwrap 14 may be formed by die-cutting a sheet of stock material, such as paperboard, to produce an overwrap blank 14'. The trapezoidal, keystone shape of the overwrap blank 14' may allow the overwrap 14 to closely correspond to the frustoconical shape of the base container 12, as shown in FIGS. 1 and 2.

The overwrap blank 14' may be wrapped onto the base container 12 to form the layered structure of the insulated container 10. Alternatively, the overwrap blank 14' may first be assembled into a sleeve, and then the sleeve may be positioned over the base container 12 to form the layered structure of the insulated container 10.

In one specific, non-limiting example, the insulated container 10 may be formed from a paperboard-based base container 12, a paperboard-based overwrap 14 and a substantially biodegradable adhesive 16 (e.g., a latex adhesive). Therefore, the insulated container 10 may be substantially biodegradable.

Referring to FIGS. 1 and 4, the overwrap 14 may include a first (comfort) zone 40, a second zone 42 and a third zone 44. Each zone 40, 42, 44 may generally circumferentially extend about the longitudinal axis A (FIG. 2) of the insulated container 10.

The comfort zone 40 may be configured to impart one or more desired tactile properties to a user grasping the container 10 in the comfort zone 40. As one example, the comfort zone 40 may have greater insulative properties than the other zones 42, 44 of the overwrap 14, as described in greater detail below. Thus, the container 10 may feel cooler when the user grasps the comfort zone 40 than if the user had grasped one of the other zones 42, 44. As a second example, the comfort zone 40 may be configured such that less condensation is formed on the surface of the comfort zone 40 (relative to the other zones 42, 44) when the container 10 is filled with a cold liquid (e.g., water) in a humid environment. Thus, the user may feel less moisture when the user grasps the comfort zone 40 rather than the other zones 42, 44. As a third example, the comfort zone 40 may have different surface texturing than the other zones 42, 44 of the overwrap 14, as described in greater detail below. Thus, the container 10 may feel different when the user grasps the comfort zone 40 rather than one of the other zones 42, 44. As a fourth example, the comfort zone 40 may be identified with indicia, such as color (e.g., brown that resembles a traditional coffee cup sleeve), that is different than the indicia used (if any) in the other zones 42, 44 of the overwrap 14, as described in greater detail below. Thus, the indicia may encourage users to grasp the container 10 at the comfort zone 40 rather than the other zones 42, 44.

The comfort zone 40 may be longitudinally positioned between the second zone 42 and the third zone 44, and may have a longitudinal length $L_1$ (FIG. 1). The longitudinal position of the comfort zone 40 may depend on the overall configuration of the insulated container 10, and may be selected such that the comfort zone 40 is positioned where a typical user would naturally grasp the insulated container 10. For example, the comfort zone 40 may be generally longitudinally centered on the insulated container 10.

Optionally, the comfort zone 40 may be marked with various indicia, such as color, text and/or graphics, to identify (or emphasize) the comfort zone 40. For example, the comfort zone 40 may be marked with a brown color (such as a brown color that resembles kraft paper), while the other zones 42, 44 may be marked with other colors (or no colors).

The longitudinal length $L_1$ of the comfort zone 40 may be of a sufficient magnitude such that a typical user may grasp the insulated container 10 entirely within the comfort zone 40 (i.e., without the user's hand extending into the adjacent second and third zones 42, 44). For example, the longitudinal length $L_1$ of the comfort zone 40 may be at least about 2 inches, such as about 3 to about 6 inches.

In one realization, the longitudinal length $L_1$ of the comfort zone 40 may be about 30 percent to about 90 percent of the total longitudinal length $L_2$ (FIG. 1) of the overwrap 14. In another realization, the longitudinal length $L_1$ of the comfort zone 40 may be about 40 percent to about 80 percent of the total longitudinal length $L_2$ of the overwrap 14. In yet another realization, the longitudinal length $L_1$ of the comfort zone 40 may be about 50 percent to about 70 percent of the total longitudinal length $L_2$ of the overwrap 14.

While the overwrap 14 is shown and described having three zones 40, 42, 44, other variations are also contemplated. In one alternative variation, the overwrap 14 may have only two zones, such as only the comfort zone 40 and the second zone 42 (i.e., the comfort zone 40 may extend to the lower edge 43 of the overwrap 14) or only the comfort zone 40 and the third zone 44 (i.e., the comfort zone 40 may extend to the upper edge 41 of the overwrap 14). In another alternative variation, the overwrap 14 may have four or more zones.

The comfort zone 40 may include a first pattern of bosses 46. As one example, the first pattern of bosses 46 may include a plurality of embossings 48 (i.e., bosses that extend outward from the overwrap 14 away from the base container 12) and a plurality of debossings 50 (i.e., bosses that extend inward from the overwrap 14 toward the base container 12), as shown in the drawings. As another example, the first pattern of bosses 46 may include only embossings 48. As yet another example, the first pattern of bosses may include only debossings 50.

The second zone 42 may include a second pattern of bosses 52. As one example, the second pattern of bosses 52 may include a plurality of debossings 54, as shown in the drawings. As another example, the second pattern of bosses 52 may include both a plurality of debossings 54 and a plurality of embossings (not shown). As yet another example, the second pattern of bosses 52 may include only a plurality of embossings (not shown).

The third zone 44 may include a third pattern of bosses 56. As one example, the third pattern of bosses 56 may include a plurality of debossings 58, as shown in the drawings. As another example, the third pattern of bosses 56 may include both a plurality of debossings 58 and a plurality of embossings (not shown). As yet another example, the third pattern of bosses 56 may include only a plurality of embossings (not shown). Optionally, as shown in the drawings, the third pattern of bosses 56 may be substantially the same as the second pattern of bosses 52.

While the embossings 48 and the debossings 50, 54, 58 are shown in the drawings as being generally circular in plan view, those skilled in the art will appreciate that embossings and debossings of various shapes and configurations, such as diamond, square, oblong, star or irregular, may be used without departing from the scope of the present disclosure. Furthermore, it is also contemplated that one or more of the zones 40, 42, 44 may be substantially free of bosses.

The first pattern of bosses 46 may have a first boss density (i.e., the total number of embossings 48 and debossings 50 per unit area of the surface of the comfort zone 40). The second pattern of bosses 52 may have a second boss density (i.e., the total number of embossings and debossings 54 per unit area of the surface of the second zone 42). The third pattern of bosses 56 may have a third boss density (i.e., the total number of embossings and debossings 58 per unit area of the surface of the third zone 44).

In a first aspect, the first boss density (the boss density of the comfort zone 40) may be substantially greater than the second boss density (the boss density of the second zone 42) and the third boss density (the boss density of the third zone 44). In one implementation of the first aspect, the first boss density may at least 1.5 times greater than the second boss density or the third boss density. In another implementation of the first aspect, the first boss density may at least 2 times greater than the second boss density or the third boss density. In another implementation of the first aspect, the first boss density may at least 3 times greater than the second boss density or the third boss density. In another implementation of the first aspect, the first boss density may at least 4 times greater than the second boss density or the third boss density. In another implementation of the first aspect, the first boss density may at least 5 times greater than the second boss density or the third boss density. In another implementation of the first aspect, the first boss density may at least 10 times greater than the second boss density or the third boss density.

In a second aspect, the first boss density may be substantially less than the second boss density and the third boss density. In one implementation of the second aspect, the second and third boss densities may at least 1.5 times greater than the first boss density. In another implementation of the second aspect, the second and third boss densities may at least 2 times greater than the first boss density. In another implementation of the second aspect, the second and third boss densities may at least 3 times greater than the first boss density. In another implementation of the second aspect, the second and third boss densities may at least 4 times greater than the first boss density. In another implementation of the second aspect, the second and third boss densities may at least 5 times greater than the first boss density. In another implementation of the second aspect, the second and third boss densities may at least 10 times greater than the first boss density.

Thus, the first pattern of bosses 46 may be different than the second and third patterns of bosses 52, 56. Specifically, the first pattern of bosses 46 may be different than the second and third patterns of bosses 52, 56 based on, for example, the type of bosses (e.g., embossings and/or debossings) used in the first pattern of bosses 46 and/or the boss density of the first pattern of bosses 46. The size (e.g., smaller versus larger) and shape (e.g., circular versus square in plan view) of the bosses in the first pattern of bosses 46 may also be different from the size and shape of the bosses in the second and third patterns of bosses 52, 56. Therefore, the comfort zone 40 may be defined by the uniqueness of the first pattern of bosses 46 relative to the boss patterns 52, 56 of the second and third zones 42, 44.

The embossings 48 and the debossings 50, 54, 58 may be formed by embossing and debossing the overwrap 14 prior to applying the overwrap to the base cup 12. For example, the embossings 48 and the debossings 50, 54, 58 may be formed by passing a sheet of paperboard through an embossing/debossing press to form the bosses 48, 50, 54, 58, die-cutting the embossed/debossed paperboard to form the overwrap blank 14' (FIG. 4), and applying the overwrap blank 14' onto the base container 12.

Referring to FIG. 2, the debossings 50, 54, 58 may protrude radially inward from the overwrap 14 such that each debossing 50, 54, 58 has a debossed depth and extends into engagement with (or at least toward) the outer surface 34 of the base container 12. As one example, the debossed depth of each debossing 50, 54, 58 may be at least 5 points. As another example, the debossed depth of each debossing 50, 54, 58 may be at least 10 points. As another example, the debossed depth of each debossing 50, 54, 58 may be at least 20 points. As another example, the debossed depth of at least some of the debossings 50, 54, 58 may range from about 10 to about 40 points. As yet another example, the debossed depth of at least some of the debossing 50, 54, 58 may range from about 20 to about 30 points.

Thus, the debossings 50, 54, 58 may function as spacers that space the overwrap 14 from the base container by a distance corresponding to the debossed depth of the deepest debossings 50, 54, 58. The spacing between the overwrap 14 and the base container 12 may define an annular region 60 between the overwrap 14 and the base container 12 that may insulate the insulated container 10. The adhesive 16 may be positioned in the annular region 60 to connect the overwrap 14 to the base container 12. Portions of the annular region 60 not filled with the adhesive 16 may be filled with ambient air.

In one optional construction, the debossings 50, 54, 58 may have a surface area (in plan view) ranging from about 25 to about 100 $mm^2$, and the center of each debossing 50, 54, 58 may be spaced at least 10 mm from the center of each adjacent debossing 50, 54, 58. Furthermore, the debossings 50 in the comfort zone 40 may be generally hemispherical (circular in plan view) and may have a diameter that is less than the diameter of the debossings 54, 58 in the second and third zones 42, 44.

In another optional construction, the total surface area of the debossings 50, 54, 58 may account for about 2 to about 20 percent of the total surface area of the outer surface 38 of the overwrap 14.

In yet another optional construction, the overwrap 14 may include about 0.25 to about 2 debossings 50, 54, 58 per square inch of the outer surface 38 of the overwrap 14.

At this point, those skilled in the art will appreciate that heat transfer between the overwrap 14 and the base container 12 may be greatest at the debossings 50, 54, 58 since the debossings 50, 54, 58 may contact the base container 12. Therefore, the debossings 50 in the comfort zone 40 may be configured to contact relatively less of the surface area of the outer surface 34 of the base container 12 than the debossings 54, 58 in the second and third zones 42, 44.

The embossings 48 may protrude radially outward from the overwrap 14 such that each embossing 58 has a protruding height. As one example, the protruding height of each embossing 48 may be at least 2 points. As another example, the protruding height of each embossing 48 may be at least 4 points. As another example, the protruding height of each embossing 48 may be at least 6 points. As another example, the protruding height of at least some of the embossings 48 may range from about 4 to about 12 points. As yet another example, the protruding height of at least some of the embossings 48 may range from about 6 to about 10 points.

Thus, the embossings 48 may texture the outer surface 38 of the overwrap 14 to enhance the ability to grip the insulated container 10.

Furthermore, the embossings 48 may further radially space portions of the overwrap 14 from the base container 12, thereby increasing the volume of the annular region 60 between the comfort zone 40 and the base container 12. With the radial spacing between the base container 12 and the comfort zone 40 being greater than the radial spacing between the base container 12 and the second and third zones 42, 44, the comfort zone 40 may be better insulated than the second and third zones 42, 44, thereby providing the comfort zone 40 with a relatively lower surface temperature than the second and third zones 42, 44 when the container 10 is filled with a hot liquid 27 (FIG. 2) or a relatively higher surface temperature than the second and third zones 42, 44 when the container 10 is filled with a cold liquid 27.

As one example, the total number, the average size and the protruding depth of the embossings 48 in the first pattern of bosses 46 may be selected to sufficiently increase the volume of the annular region 60 between the base container 12 and the comfort zone 40 such that the outer surface 38 of the comfort zone 40 has an average surface temperature that is at least 1° C. less than the average surface temperature of the outer surface 38 of the second and third zones 42, 44 when the container 10 is filled with water at a temperature of 90° C. under TAPPI standard conditions (23° C. and 50 percent relative humidity). As another example, the outer surface 38 of the comfort zone 40 may have an average surface temperature that is at least 2° C. less than the average surface temperature of the outer surface 38 of the second and third zones 42, 44 when the container 10 is filled with water at a temperature of 90° C. under TAPPI standard conditions. As another example, the outer surface 38 of the comfort zone 40 may have an average surface temperature that is at least 3° C. less than the average surface temperature of the outer surface 38 of the second and third zones 42, 44 when the container 10 is filled with water at a temperature of 90° C. under TAPPI standard conditions. As another example, the outer surface 38 of the comfort zone 40 may have an average surface temperature that is at least 4° C. less than the average surface temperature of the outer surface 38 of the second and third zones 42, 44 when the container 10 is filled with water at a temperature of 90° C. under TAPPI standard conditions. As another example, the outer surface 38 of the comfort zone 40 may have an average surface temperature that is at least 5° C. less than the average surface temperature of the outer surface 38 of the second and third zones 42, 44 when the container 10 is filled with water at a temperature of 90° C. under TAPPI standard conditions. As another example, the outer surface 38 of the comfort zone 40 may have an average surface temperature that is at least 10° C. less than the average surface temperature of the outer surface 38 of the second and third zones 42, 44 when the container 10 is filled with water at a temperature of 90° C. under TAPPI standard conditions.

In one optional implementation, the embossings 48 may have a surface area that is less than the surface area of the debossings 50, 54, 58. As one example, the embossings 48 may have a surface area (in plan view) that is at most 50 percent of the surface area of the debossings 50, 54, 58. As another example, the embossings 48 may have a surface area (in plan view) that is at most 25 percent of the surface area of the debossings 50, 54, 58. As yet another example, the embossings 48 may have a surface area (in plan view) that is at most 10 percent of the surface area of the debossings 50, 54, 58.

In another optional implementation, the total surface area of the embossings 48 may account for about 50 to about 95 percent of the total surface area of the comfort zone 40.

In yet another optional construction, the embossings 48 may be spaced across the comfort zone 40 such that the center of each embossing 48 is spaced about 1 to 10 mm from the center of each adjacent embossing 48.

The adhesive 16 may be positioned in the annular region 60 between the overwrap 14 and the base container 12 to connect the overwrap 14 to the base container 12. Various adhesives 16, including water-based adhesive (e.g., latex adhesives) and organic solvent-based adhesive, may be used to connect the overwrap 14 to the base container 12.

Optionally, the adhesive 16 may be a thermally insulating adhesive. A suitable thermally insulating adhesive may be formed as a composite material that includes an organic binder and a filler. The organic binder may comprise 15 to 70 percent by weight of the adhesive 30 and the filler may comprise 2 to 70 percent by weight of the adhesive.

The organic binder component of the thermally insulating adhesive 16 may be any material, mixture or dispersion capable of bonding the overwrap 14 to the base container 12. The organic binder may also have insulating properties. Examples of suitable organic binders include latexes, such as styrene-butadiene latex and acrylic latex, starch, such as ungelatinized starch, polyvinyl alcohol, polyvinyl acetate, and mixtures and combinations thereof.

The filler component of the thermally insulating adhesive 16 may include an organic filler, an inorganic filler, or a combination of organic and inorganic fillers. Organic fillers include hard organic fillers and soft organic fillers. Examples of suitable hard organic fillers include sawdust and ground wood. Examples of suitable soft organic fillers include cellulose pulp, pearl starch, synthetic fiber (e.g., rayon fiber), gluten feed, corn seed skin and kenaf core (a plant material). Examples of suitable inorganic fillers include calcium carbonate, clay, perlite, ceramic particles, gypsum and plaster. For example, organic filler may comprise 2 to 70 percent by weight of the thermally insulating adhesive 16 and inorganic filler may comprise 0 to 30 percent by weight of the thermally insulating adhesive 16.

All or a portion of the filler may have a relatively high particle size (e.g., 500 microns or more). The use of high particle size filler material may provide the thermally insulating adhesive 16 with structure such that the thermally insulating adhesive 16 functions to further space the overwrap 14 from the base container 12. For example, the thermally insulating adhesive 16 may be formed as a composite material that includes an organic binder and a hard organic filler, such as sawdust, that has an average particle size of at least 500 microns, such as about 1000 to about 2000 microns.

In one particular expression, the thermally insulating adhesive 16 may be a foam. The foam may be formed by mechanically whipping the components of the thermally insulating adhesive 16 prior to application. Optionally, a foam forming agent may be included in the adhesive layer formulation to promote foam formation. As one example, 10 to 60 percent of the foam of the thermally insulating adhesive 16 may be open voids, thereby facilitating the absorption of moisture. As another example, 10 to 30 percent of the foam of the thermally insulating adhesive 16 may be open voids.

In another particular expression, the thermally insulating adhesive 16 may be formed from a binder-filler formulation having a pseudoplasticity index in the range of 0.3 to 0.5. Such a pseudoplasticity index may provide the thermally insulating adhesive 16 with a sufficient minimum thickness, while preserving the ability to apply the formulation at a low viscosity. For example, the formulation may have a low shear viscosity in the range of 2,000 to 50,000 centipoises and a high shear viscosity in the range of 100 to 5,000 centipoises.

As one option, the thermally insulating adhesive 16 may additionally include a plasticizer. The plasticizer may comprise 0.5 to 10 percent by weight of the thermally insulating adhesive 16. Examples of suitable plasticizers include sorbitol, Emtal emulsified fatty acids and glycerine.

As another option, the thermally insulating adhesive 16 may additionally include sodium silicate, which may act as a filler, but is believed to aid in binding and curing of the binder by rapidly increasing viscosity of the binder during the drying process. The sodium silicate may comprise 0 to 15 percent by weight of the thermally insulating adhesive 16, such as about 1 to about 5 percent by weight of the thermally insulating adhesive 16.

As yet another option, the thermally insulating adhesive 16 may be formulated to be biodegradable.

As a specific example, the thermally insulating adhesive 16 may include styrene-butadiene or acrylic SRB latex (binder), wood flour (organic filler), AeroWhip® (foam stabilizer available from Ashland Aqualon Functional Ingredients of Wilmington, Del.), corn fibers (organic filler), calcium carbonate (inorganic filler) and starch (binder), wherein the components of the thermally insulating adhesive have been mechanically whipped together to form a foam. Other examples of suitable thermally insulating adhesives are described in greater detail in U.S. Ser. No. 13/080,064 filed on Apr. 5, 2011, the entire contents of which are incorporated herein by reference.

Figure 5:
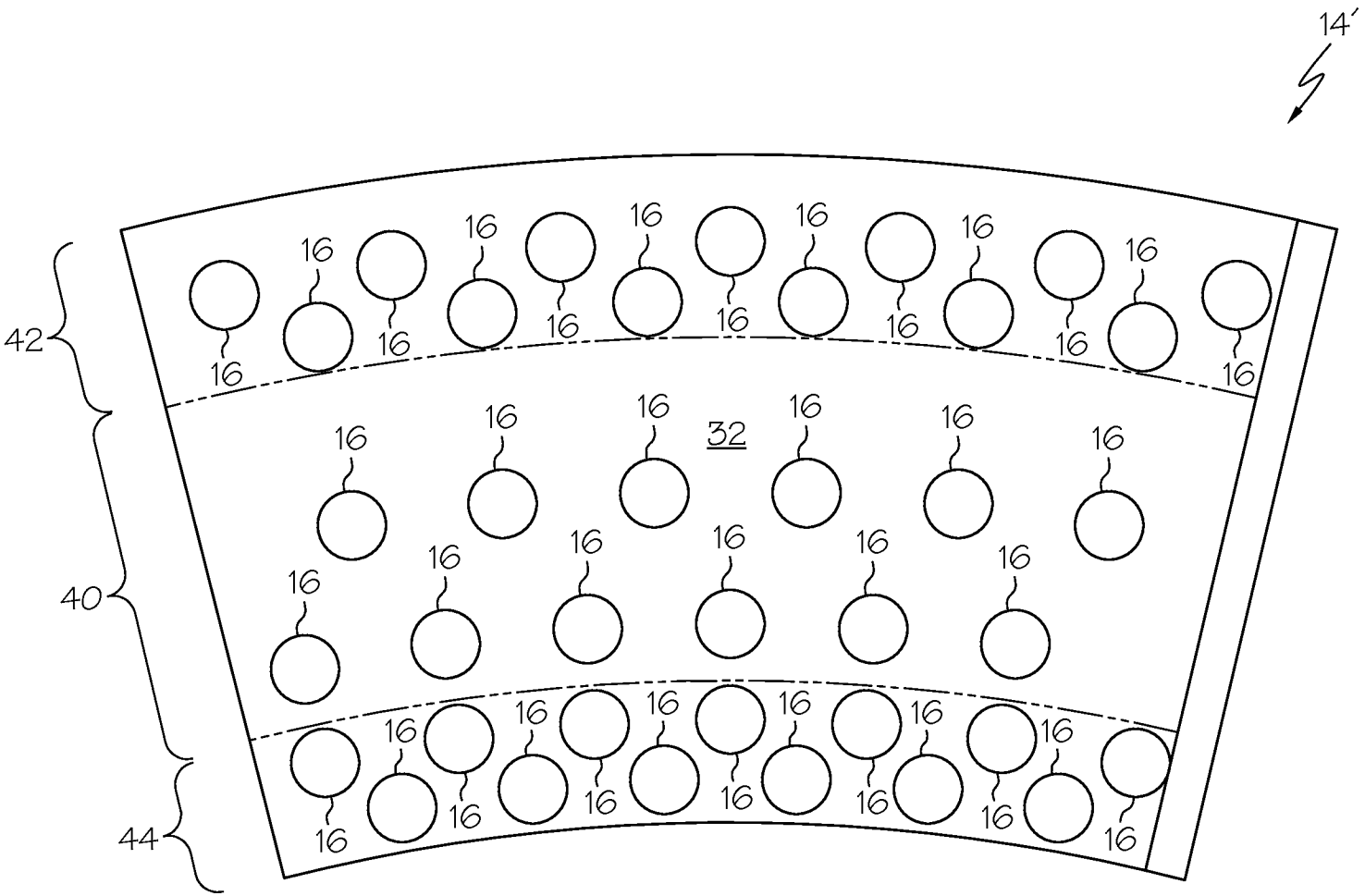
FIG. 5 is a bottom plan view of the overwrap of FIG. 4.
Figure 6:
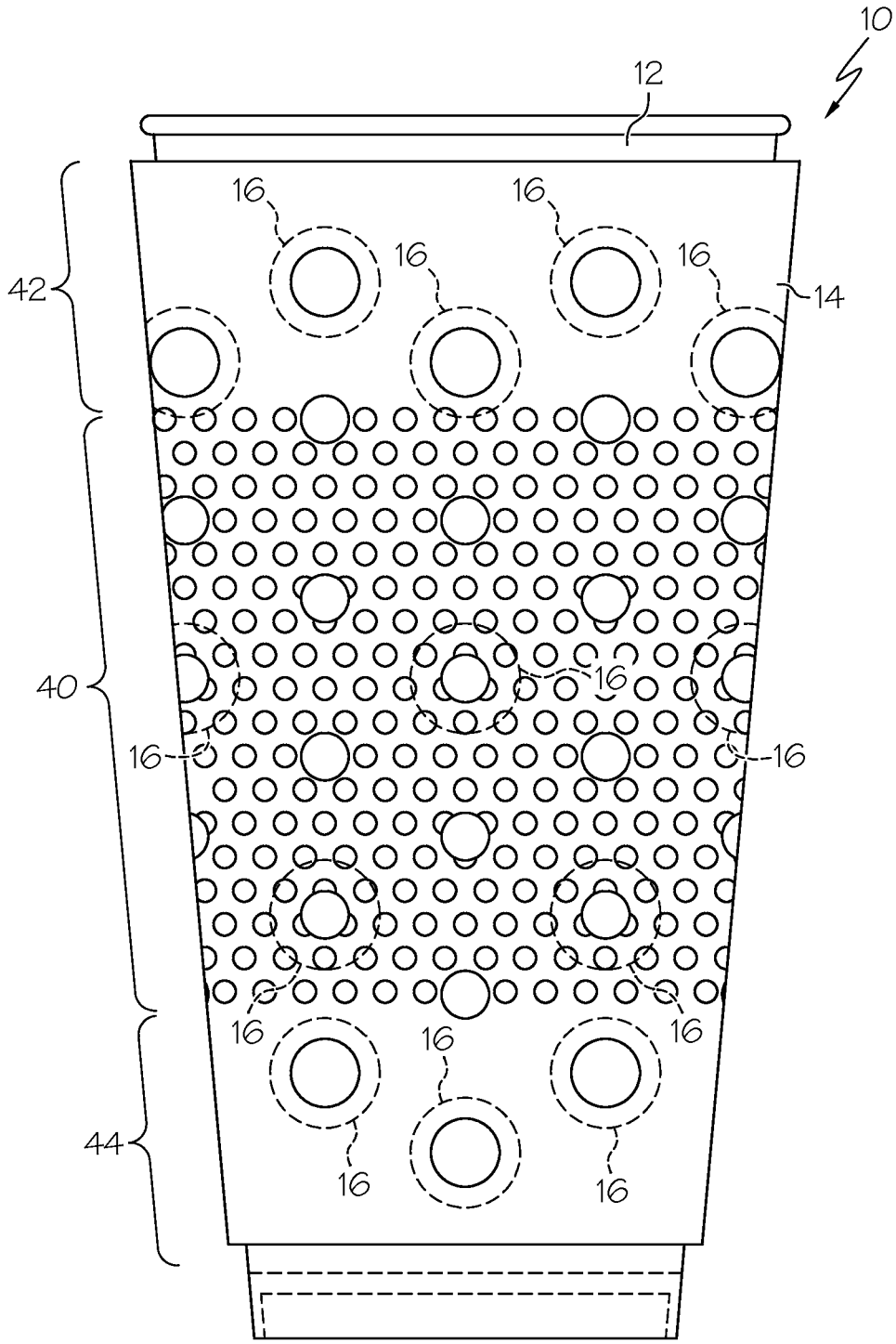
FIG. 6 is a front elevational view of the insulated container of FIG. 1, showing, in phantom, the adhesive between the base cup and the overwrap.

The adhesive 30 may be applied in various ways to connect the overwrap 14 and the base container 12. For example, as shown in FIGS. 5 and 6, the adhesive may be applied in a dot pattern. However, other patterns, such as strings or random patterns, are also contemplated.

It has now been discovered that heat transfer across the annular region 60 (i.e., from the base container 12 to the overwrap 14) may be greatest at the adhesive 16, even when a thermally insulating adhesive is used (air is generally a better insulator). Therefore, when the insulated container 10 is filled with a hot liquid 27 as shown in FIG. 2, the average surface temperature of the comfort zone 40 may be lower relative to the average surface temperatures of the second and third zones 42, 44 if there is relatively less adhesive 16 between the comfort zone 40 and the base container 12 than between the second and third zones 42, 44 and the base container 12.

Thus, a sufficient amount of adhesive 16 may be used to ensure a proper connection between the overwrap 14 and the base container 12. However, the adhesive 16 may be concentrated between the base container 12 and the second and third zones 42, 44, rather than between the base container 12 and the comfort zone 40, such that heat transfer to the comfort zone 40 is minimized, thereby beneficially reducing the average surface temperature at the comfort zone 40 when the insulated container 10 is filled with a hot liquid 27.

As one example, the adhesive 16 may be concentrated between the base container 12 and the second and third zones 42, 44 such that the outer surface 38 of the comfort zone 40 has an average surface temperature that is at least 1° C. less than the average surface temperature of the outer surface 38 of the second and third zones 42, 44 when the container 10 is filled with water at a temperature of 90° C. under TAPPI standard conditions. As another example, the adhesive may be arranged such that the outer surface 38 of the comfort zone 40 has an average surface temperature that is at least 2° C. less than the average surface temperature of the outer surface 38 of the second and third zones 42, 44 when the container 10 is filled with water at a temperature of 90° C. under TAPPI standard conditions. As another example, the adhesive may be arranged such that the outer surface 38 of the comfort zone 40 has an average surface temperature that is at least 3° C. less than the average surface temperature of the outer surface 38 of the second and third zones 42, 44 when the container 10 is filled with water at a temperature of 90° C. under TAPPI standard conditions. As another example, the adhesive may be arranged such that the outer surface 38 of the comfort zone 40 has an average surface temperature that is at least 4° C. less than the average surface temperature of the outer surface 38 of the second and third zones 42, 44 when the container 10 is filled with water at a temperature of 90° C. under TAPPI standard conditions. As another example, the adhesive may be arranged such that the outer surface 38 of the comfort zone 40 has an average surface temperature that is at least 5° C. less than the average surface temperature of the outer surface 38 of the second and third zones 42, 44 when the container 10 is filled with water at a temperature of 90° C. under TAPPI standard conditions. As another example, the adhesive may be arranged such that the outer surface 38 of the comfort zone 40 has an average surface temperature that is at least 10° C. less than the average surface temperature of the outer surface 38 of the second and third zones 42, 44 when the container 10 is filled with water at a temperature of 90° C. under TAPPI standard conditions.

Referring to FIGS. 5 and 6, the adhesive 16 may be applied to the inner surface 36 of the overwrap 14 such that the percentage of the surface area of the comfort zone 40 covered by the adhesive 16 is less than the percentage of the surface area of the second and third zones 42, 44 covered by the adhesive 16. For example, at most 5 percent of the surface area of the comfort zone 40 may be covered with the adhesive 16, while greater than 5 percent (e.g., about 10 to about 20 percent) of the surface area of the second and third zones 42, 44 may be covered with the adhesive 16.

When the adhesive 16 is applied to the container 10 in a dot pattern, the density of adhesive dots (i.e., the number of adhesive dots per unit area) in the comfort zone 40 may be less than the density of the adhesive dots in the second and third zones 42, 44. As one example, the density of adhesive dots in the comfort zone 40 may be at most about 80 percent of the density of the adhesive dots in the second and third zones 42, 44. As another example, the density of adhesive dots in the comfort zone 40 may be at most about 60 percent of the density of the adhesive dots in the second and third zones 42, 44. As one example, the density of adhesive dots in the comfort zone 40 may be at most about 40 percent of the density of the adhesive dots in the second and third zones 42, 44.

Accordingly, the disclosed insulated container 10 may include an overwrap 14 positioned over a base container 12, wherein the overwrap includes a circumferentially extending comfort zone 40. The comfort zone 40 may be defined by a texturing pattern 46 that may be different than the texturing patterns (if any) of the adjacent zones 42, 44. Furthermore, the adhesive 16 may be arranged between the overwrap 14 and the base container 12 such that the surface of the comfort zone 40 is cooler than the surfaces of the adjacent zones 42, 44 when the insulated container 10 is filled with a hot liquid.

Although various embodiments of the disclosed insulated container with debossed overwrap have been shown and described, modifications may occur to those skilled in the art upon reading the specification. The present application includes such modifications and is limited only by the scope of the claims.

What is claimed is:

1. A container comprising:

a base container comprising a side wall that extends about a longitudinal axis to define an internal volume;

an overwrap positioned over said side wall to define a region between said base container and said overwrap, said overwrap comprising:

a first zone circumferentially extending about said base container, said first zone comprising a first pattern of bosses having a first boss density, wherein said first pattern of bosses comprises a first plurality of debossings and a plurality of embossings; and a second zone circumferentially extending about said base container, said second zone comprising a second pattern of bosses having a second boss density, wherein said second pattern of bosses comprises a second plurality of debossings, wherein said second pattern of bosses is different than said first pattern of bosses, and wherein said first boss density is different than said second boss density; and an adhesive positioned in said region to connect said base container to said overwrap.

2. The container of claim 1 wherein said side wall has an outer surface having a total surface area, and wherein said first pattern of debossings is in contact with a first percentage of said total surface area and said second pattern of debossings is in contact with a second percentage of said total surface area, said first percentage being less than said second percentage.

3. The container of claim 1 wherein said overwrap has a first longitudinal length and said first zone has a second longitudinal length, said second longitudinal length being about 40 to about 80 percent of said first longitudinal length.

4. The container of claim 1 wherein said first zone is marked with indicia, said indicia comprising a brown color.

5. The container of claim 1 wherein said first zone has a first inner surface area and said second zone has a second inner surface area, and wherein a first percentage of said first inner surface area is covered with said adhesive and a second percentage of said second inner surface area is covered with said adhesive, said first percentage being less than said second percentage.

6. The container of claim 1 wherein said first zone has a first inner surface area and said second zone has a second inner surface area, and wherein at most 10 percent of said first inner surface area is covered with said adhesive and more than 5 percent of said second inner surface area is covered with said adhesive.

7. The container of claim 1 wherein said first boss density is at least 1.5 times said second boss density.

8. The container of claim 1 wherein said first boss density is at least 2 times said second boss density.

9. The container of claim 1 wherein said second boss density is at least 1.5 times said first boss density.

10. The container of claim 1 wherein said second boss density is at least 2 times said first boss density.

11. The container of claim 1 wherein said adhesive forms a string pattern between said base container and said overwrap.

12. The container of claim 1 wherein said overwrap further comprises a third zone circumferentially extending about said base container, said third zone comprising a third pattern of bosses, wherein said third pattern of bosses is different than said first pattern of bosses.

13. The container of claim 12 wherein said first zone is positioned between said second zone and said third zone.

14. The container of claim 1 wherein said adhesive comprises an organic binder and a filler.

15. The container of claim 14 wherein said filler comprises an organic filler.

16. A container comprising:

a base container comprising a side wall that extends about a longitudinal axis to define an internal volume;

an overwrap positioned over said side wall to define a region between said base container and said overwrap, said overwrap comprising:

a first zone circumferentially extending about said base container, said first zone comprising a first pattern of bosses having a first boss density;

a second zone circumferentially extending about said base container, said second zone comprising a second pattern of bosses having a second boss density, wherein said second pattern of bosses is different than said first pattern of bosses, and wherein said second boss density is different than said first boss density; and a third zone circumferentially extending about said base container, said third zone comprising a third pattern of bosses, wherein said third pattern of bosses is different than said first pattern of bosses; and an adhesive positioned in said region to connect said base container to said overwrap.

17. The container of claim 16 wherein said first zone is positioned between said second zone and said third zone.

18. The container of claim 16 wherein said first zone is marked with indicia, said indicia comprising a brown color.

* * * * *